US007077656B2

(12) United States Patent
Miura

(10) Patent No.: US 7,077,656 B2
(45) Date of Patent: Jul. 18, 2006

(54) ROTATING ELECTRONIC PART AND METHOD OF MANUFACTURING THE SAME

(75) Inventor: Seiki Miura, Tsuyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/192,296

(22) Filed: Jul. 28, 2005

(65) Prior Publication Data

US 2006/0030168 A1 Feb. 9, 2006

(30) Foreign Application Priority Data

Aug. 5, 2004 (JP) ..... 2004-229221

(51) Int. Cl.
*H01R 39/00* (2006.01)
*J01R 12/00* (2006.01)

(52) U.S. Cl. ..... 439/22; 439/76.1; 29/837; 29/852; 338/162

(58) Field of Classification Search ..... 439/13, 439/76.1, 21–26; 29/837, 848, 852, 856; 338/162, 163, 174, 175
See application file for complete search history.

(56) References Cited

U.S. PATENT DOCUMENTS

| | | | | |
|---|---|---|---|---|
| 4,914,417 | A * | 4/1990 | Matsui et al. | 338/174 |
| 5,939,973 | A * | 8/1999 | Imamura | 338/172 |
| 6,506,984 | B1 * | 1/2003 | Tomita | 200/11 R |
| 6,595,782 | B1 * | 7/2003 | Hsiao | 439/13 |
| 6,962,498 | B1 * | 11/2005 | Kohen et al. | 439/21 |
| 2006/0030168 | A1 * | 2/2006 | Miura | 439/22 |

FOREIGN PATENT DOCUMENTS

JP 04-097305 8/1992

* cited by examiner

*Primary Examiner*—James R. Harvey
(74) *Attorney, Agent, or Firm*—RatnerPrestia

(57) ABSTRACT

A rotating electronic part has a board; a case composed of insulating resin; a supporting projection made of resin integrally structured with the case; and a rotating member. The board is provided with a central hole and three or more notches around the central hole at even angular intervals. The case fixes the board so as to maintain a penetration state of the central hole on the board. Each of the supporting projections is partially provided in one of the notches and projects to an inner radius of the central hole. The rotating member has a shaft inserted in the central hole on the board and is rotatably supported at the distal ends of the supporting projections; and a contact that faces to the board, makes a rotational movement with the rotation of the shaft, and contacts the board to output electric signals outward.

8 Claims, 4 Drawing Sheets

ROTATING ELECTRONIC PART AND METHOD OF MANUFACTURING THE SAME

BACKGROUND OF THE INVENTION

1. Field of the Invention

The present invention relates to a rotating electronic part that is used for composing an input operation unit for various types of electronic devices, for controlling temperature of a car air-conditioner, and for controlling audio and visual signals of a household electronic appliance such as audio-visual equipment; and to a method of manufacturing the rotating electronic part.

2. Background Art

In recent years, there is a demand for a rotating electronic part, which controls volume and images for audiovisual equipment and the like, with a favorable touch and high reliability. A description will be made for such a conventional rotating electronic part, referring to FIG. 7. FIG. 7 is a sectional view of a rotating variable resistor as the conventional rotating electronic part.

Board 1 is a wiring board made of a paper-based phenolic resin laminated sheet or glass epoxy resin laminated sheet. Board 1 is die-cut to provide central hole 1A with a round shape. The top surface has an outer edge formed with resistor element part 1B and an inner side formed with conductive part 1C, concentrically by means of printing or the like. Resistor element part 1B and conductive part 1C are electrically connected to external lead terminals 2 individually swaged to board 1, respectively. Board 1 is fixed to the bottom surface in the recess of case 3 made of insulating resin, by insert molding, so that the surface on which resistor element part 1B and conductive part 1C are provided face to the side of the upper open of the recess.

Wall 3B, a side wall composing a recess in case 3, is formed so as to enclose board 1 to fix the outer edge on board 1. The inner bottom of the recess in case 3 is provided with fit hole 3A with a round shape aligned with central hole 1A on board 1 with the same diameter, in a penetrating state.

Rotor 4 has tubelike shaft 4C and flat-shaped flange 4B. Shaft 4C projecting downward is inserted to central hole 1A and fit hole 3A from up above. The thin-walled bottom end of shaft 4C is swaged in a horn-like shape and combined with case 3 so that rotor 4 is rotatable. Through-hole 4A, provided at the center of shaft 4C, has an oval shape. The top of rotor 4 is provided with flange 4B, which covers the top face of the recess in case 3 with being combined with case 3. Brushes 5, slidingly contacting the tops of resistor element part 1B and conductive part 1C respectively, are fixed to the bottom surface of flange 4B.

The conventional rotating variable resistor structured as mentioned above is used along with a rotation aid or the like fit for oval through-hole 4A of rotor 4, inserted to through-hole 4A. More specifically, when rotor 4 is rotated through a rotation aid or the like, brushes 5, fixed to the bottom surface of flange 4B, slide on resistor element part 1B and conductive part 1C on board 1. Consequently, a resistance value is given between terminals 2 according to the rotating position of brushes 5. Such a rotating variable resistor is disclosed in Japanese Utility Model Unexamined Publication No. H04-97305, for example.

In manufacturing such a rotating variable resistor, board 1 is insert-molded with insulating resin, on the basis of central hole 1A with a round shape on board 1, to form case 3. Therefore, the die-cut shear plane is exposed on the internal end surface of central hole 1A on board 1. As a result, when shaft 4C rotates accompanied by rotation of rotor 4 while contacting the shear plane of central hole 1A, the rough surface of the shear plane causes a rough touch in operation. Meanwhile, if this part is shaved, the powdered shavings may enter conductive part 1C and others on board 1 to be possible to make noise.

SUMMERY OF THE INVENTION

A rotating electronic part according to the present invention has a board; a case composed of insulating resin; a supporting projection made of resin integrally structured with the case; and a rotating member. The board is provided with a central hole and three or more notches around the central hole at even angular intervals. The case fixes the board so as to maintain a penetration state of the central hole on the board. Each of the supporting projections is partially provided in one of the notches and projects to an inner radius of the central hole. The rotating member has a shaft inserted in the central hole on the board and is rotatably supported at the distal ends of the supporting projections; and a contact that faces to the board, makes a rotational movement with the rotation of the shaft, and contacts the board to output electric signals outward. With this makeup, the shaft does not rotationally contact the internal surface of the central hole on the board even in rotation, making the rotational touch favorable.

DETAILED DESCRIPTION OF THE INVENTION

Figure 1:
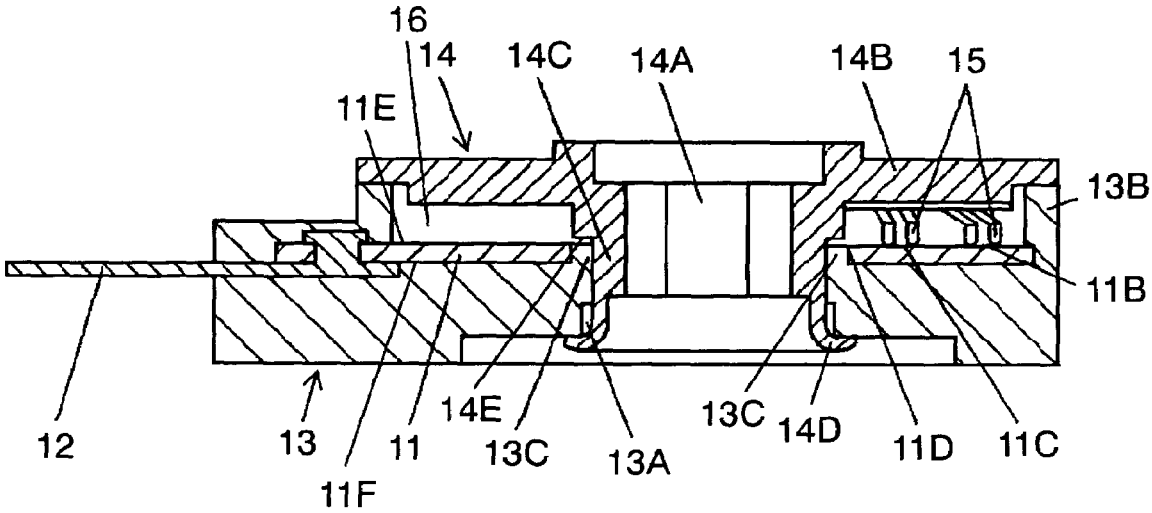
FIG. 1 is a sectional view of a rotating variable resistor according to an embodiment of the present invention.
Figure 2:
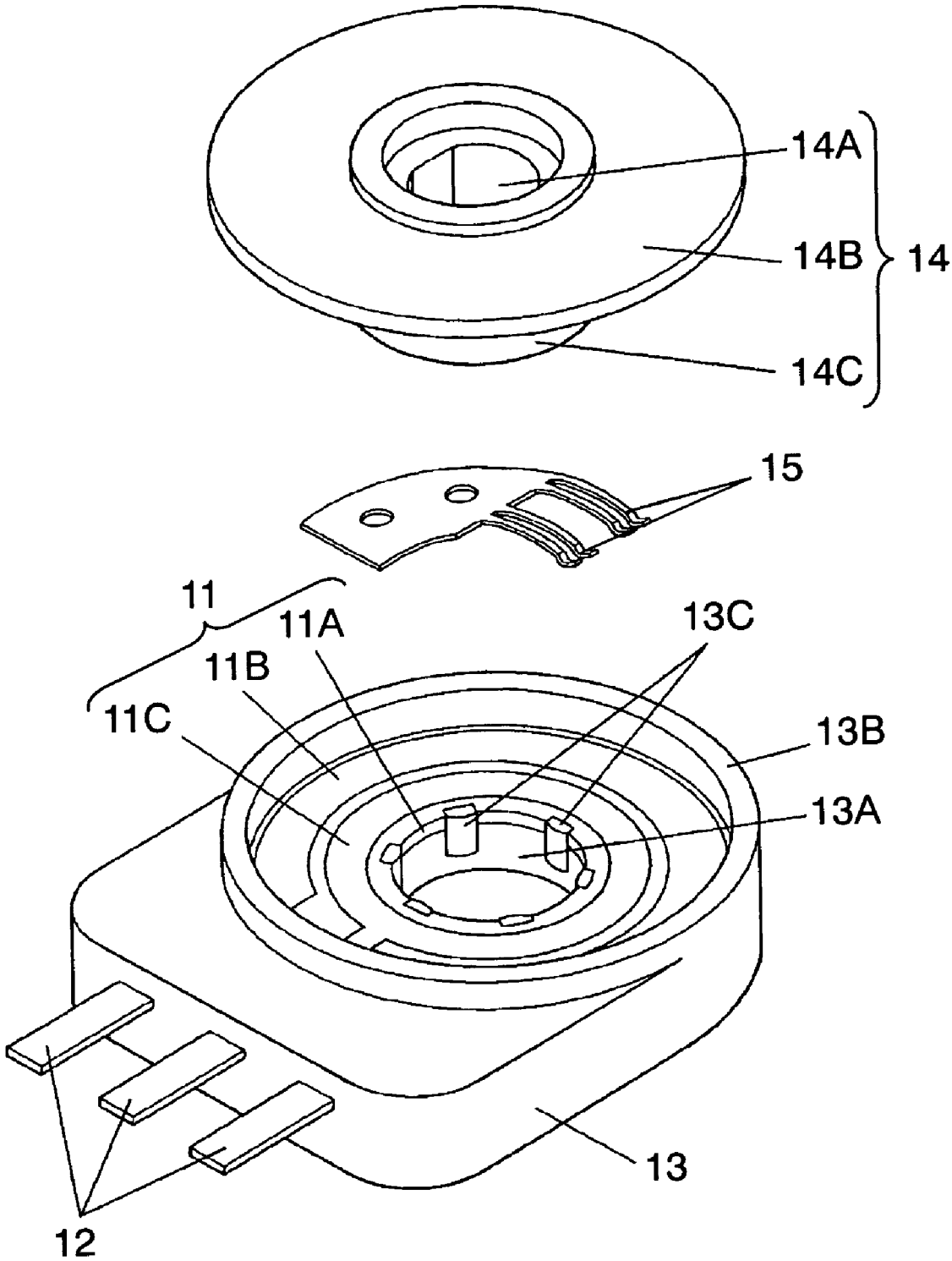
FIG. 2 is an exploded perspective view of the rotating variable resistor shown in FIG. 1.

FIG. 1 is a sectional view of a rotating variable resistor as a rotating electronic part according to an embodiment of the present invention, and FIG. 2 is an exploded perspective view of the same.

Board 11 is an insulated board made of a paper-based phenolic resin laminated sheet or glass epoxy resin laminated sheet, die-cut to provide central hole 11A with a round shape. The top surface has an outer edge formed with resistor element part 11B and an inner side formed with conductive part 11C, concentrically by means of printing or the like. Resistor element part 11B and conductive part 11C are electrically connected to external lead terminals 12 individually fixed to board 11, respectively.

Case 13, made of insulating resin, is formed by insert-molding board 11. Board 11 is fixedly retained so that upper surface 11E, which is a first surface provided with resistor element part 11B and conductive part 11C thereon, is exposed at the inner bottom of recess 16 enclosed by toric wall 13B. Round fit hole 13A, with the same diameter as central hole 11A, is provided in a penetrating state, at a position corresponding to central hole 11A on board 11 on the inner bottom of recess 16 of case 13. In other words, case 13 fixes board 11 so as to maintain a penetration state of central hole 11A. Bottom surface 11F, which is a second surface facing to top surface 11E, is buried in the resin of case 13 by insert molding at the inner bottom of recess 16.

Rotor 14, made of insulating resin, as a rotating member, has flange 14B at its upper side, and shaft 14C formed projecting in a tubelike shape at its lower side. Brushes 15, sliding the tops of resistor element part 11B and conductive part 11C respectively, are fixed to the bottom surface of flange 14B. Brushes 15 are contacts that face to top surface 11E of board 11, make a rotational movement with rotation of shaft 14C. Each of Brushes 15 contacts with resistor element part 11B or conductive part 11C provided on top surface 11E to output electric signals outward. Shaft 14C is inserted to the inner parts of central hole 11A and fit hole 13A from the above. Thin-walled part 14D at the bottom end of shaft 14C is swaged to the lower outer circumference of fit hole 13A in a horn-like shape so that rotor 14 is rotatable. In such a state, flange 14B covers the top face of recess 16 composed of wall 13B of case 13. Through-hole 14A formed in the center of shaft 14C has an oval shape.

Figure 3:
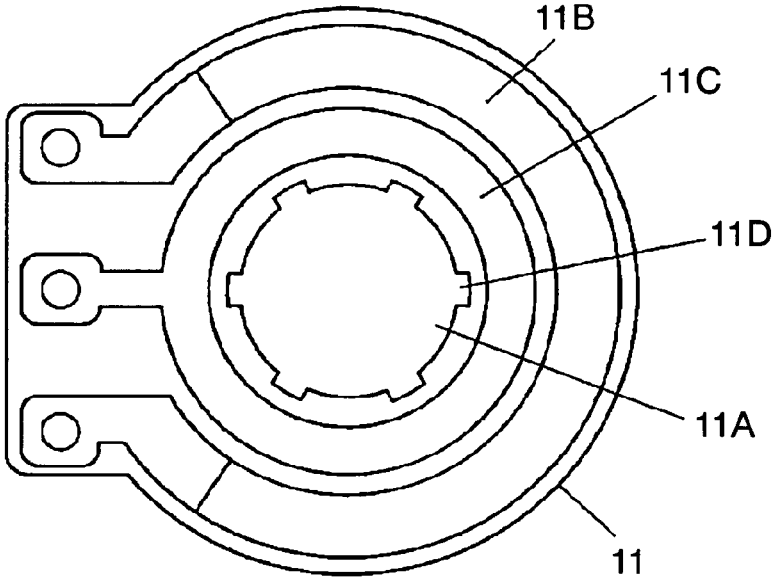
FIG. 3 is a plan view of a board of the rotating variable resistor shown in FIG. 1.

Case 13 is provided with supporting projections 13C structured integrally with case 13 at even angular intervals as shown in FIG. 2. Meanwhile, as shown in FIG. 3, which is the plan view of board 11, the periphery composing central hole 11A on board 11 is provided with six notches 11D at even angular intervals. Each supporting projection 13C is inserted in each notch 11D.

Each supporting projection 13C projects toward the inside of central hole 11A with an arc-shaped form in the horizontal cross section. The virtual line connecting each distal end of supporting projections 13C is concentric with central hole 11A on board 11 and circular with a diameter smaller than central hole 11A. The top end of each of supporting projections 13C is within the thickness of board 11 and the bottom end is within fit hole 13A. The bottom end has the same shape as the top end viewed from the top. Each supporting projection 13C is shaped like a semicylinder viewed form the side, in a line contact state with shaft 14C of rotor 14 in the axis direction. Shaft 14C is rotatably supported by each supporting projection 13C in a line contact state.

For the rotating variable resistor composed in this way, a rotation aid or the like corresponding with oval through-hole 14A of rotor 14 is inserted in through-hole 14A, and rotor 14 is rotated through the rotation aid or the like. Alternatively, rotor 14 itself is directly rotated with a finger or the like. Then, brushes 15 mounted on flange 14B slide on resistor element part 11B and conductive part 11C on board 11 respectively with rotating operations like these. Consequently, a resistance value according to an arbitrary position of rotating operation is available from terminals 12 through brushes 15.

In this makeup, supporting projections 13C whose distal ends are positioned at an inner radius of central hole 11A on board 11, rotatably support shaft 14C. Therefore, shaft 14C rotates without contacting the inner circumference of central hole 11A in rotating operation. This results in a favorable operation touch in rotating operation. In addition, each distal end of each of six supporting projections 13C arranged at even angular intervals, each shaped like a semicylinder, supports shaft 14C in a line contact state in the axis direction. Therefore, jouncing of rotor 14 is suppressed, bringing a favorable rotation touch.

When central hole 11A has a shear plane on its inner circumference due to die-cutting, this effect is particularly prominent. That is, roughness and the like are suppressed, bringing a favorable operation touch. Further, shaft 14C does not contact the shear plane of central hole 11A, and thus the shear plane is not shaved with rotating operation or the like, increasing reliability in electrical characteristic.

A part of the upper portion of each of supporting projection 13C built within the thickness of board 11 is provided in notch 11D around central hole 11A. Here, supporting projections 13C can be formed by filling notches 11D with insulating resin by insert molding. Even if the upper parts of supporting projections 13C are provided on the shear plane of board 11, forming supporting projections 13C in this way prevents the shear plane of board 11 from shaving.

Further, central hole 11A on board 11 is to be round, notches 11D are provided around central hole 11A at even angular intervals, and each supporting projection 13C is provided in each notch 11D. Case 13 in this makeup can be manufactured by insert-molding board 11 with positioning board 11 at an arc-shaped part of central hole 11A, excluding the positions of notches 11D. Therefore, all of the centers of central hole 11A, fit hole 13A and the virtual circle connecting each distal ends of supporting projections 13C, can be easily centered with a high degree of accuracy. As mentioned above, when insert-molding board 11 to form case 13, supporting projections 13C can be formed by filling notches 11D with insulating resin by simultaneous insert molding.

Figure 4:
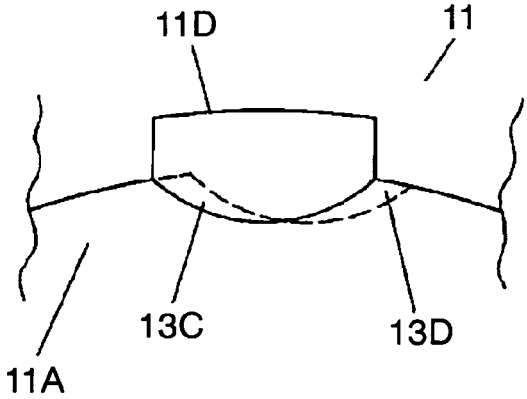
FIGS. 4 and 5 are enlarged partial views for illustrating the relationship between a supporting projection and a notch, both essential parts of the rotating variable resistor shown in FIG. 1.

As shown by solid lines in FIG. 4, forming supporting projection 13C with its width in its horizontal cross section to be the same as the entire width of notch 11D provided on board 11, desirably extends the diameter of the arc-shape. In such a setting, supporting projection 13C may be formed slightly out of alignment in the circumferential direction, depending on accuracy in insert molding of board 11, variation in processing or the like. In other words, as shown by broken lines in the figure, thin-walled part 13D may be formed at the end position of supporting projection 13C. It is important to adequately control accuracy of the molding die and in processing, to avoid such insufficient filling of resin and defective molding of supporting projection 13C.

Figure 5:
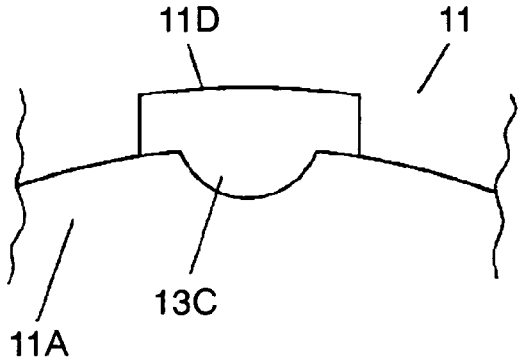

Meanwhile, as shown in FIG. 5, supporting projection 13C may be provided with its width in its horizontal cross section to be shorter than that of notch 11D. In other words, supporting projection 13C may be provided at a position excluding the end position of notch 11D contacting central hole 11A. This shape allows reducing occurrences of thin-walled part 13D shown in FIG. 4. In other words, when forming case 13 by insert molding, this shape allows reducing occurrences of defective molding such as insufficient filling of supporting projection 13C formed simultaneously with resin. This simplifies control in processing. The dimensional difference between the width of supporting projection 13C in its horizontal cross section and that of notch 11D could be determined considering accuracy of insert-molding die, processing accuracy of and notch 11D and the like.

The above description is made for a case where supporting projections 13C are allocated at six positions on the circumference at even angular intervals, as an example. However, the number of supporting projection 13C is not limited to six. It is adequate as long as shaft 14C of rotor 14 is rotatably supported, and thus supporting projections 13C could be allocated at three or more positions at even angular intervals. Central hole 11A may be of a shape other than a round one.

Figure 6:
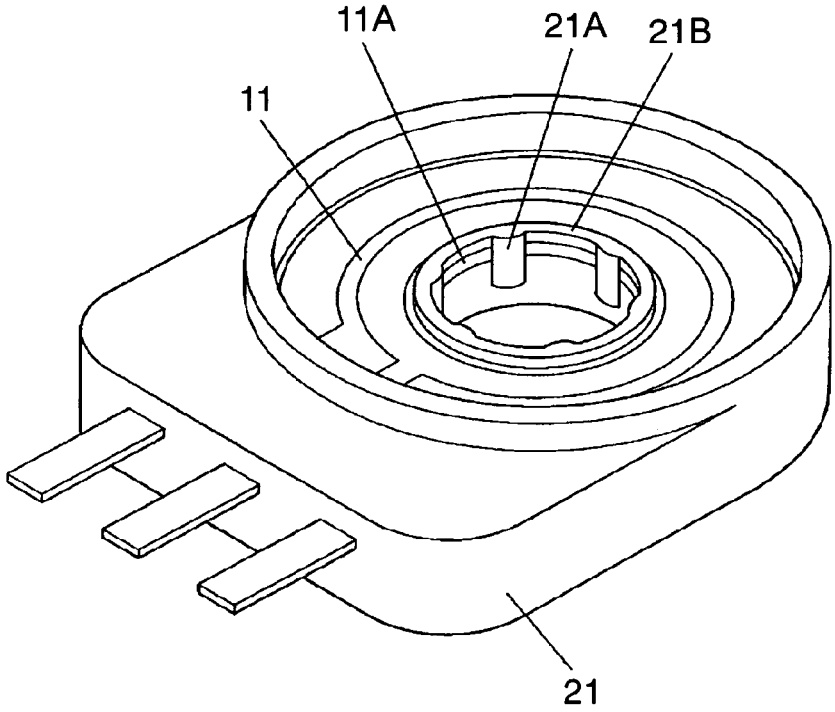
FIG. 6 is a perspective view of another insulated case of a rotating variable resistor according to the embodiment of the present invention.
Figure 7:
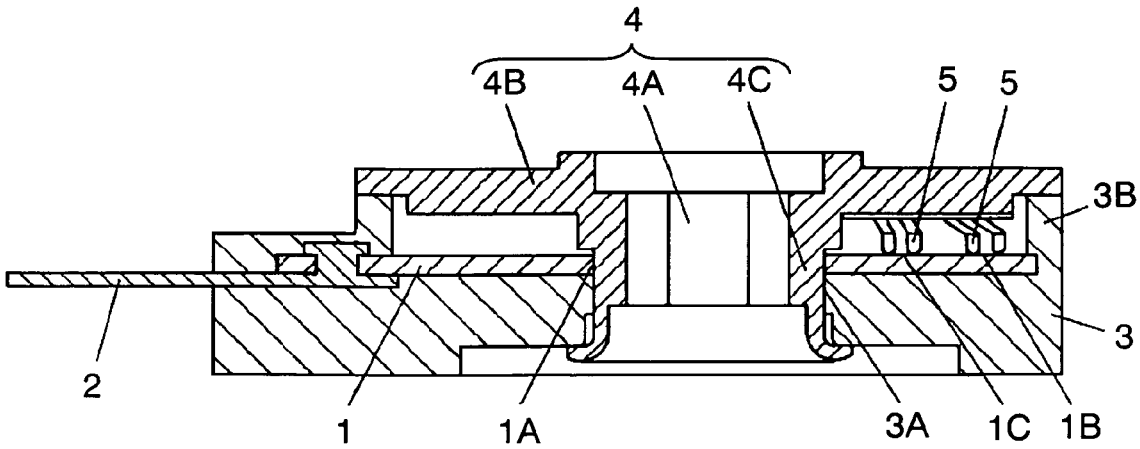
FIG. 7 PRIOR ART
FIG. 7 is a sectional view of the conventional rotating variable resistor.

Further, as shown by the perspective view in FIG. 6, case 21 made of insulating resin may be formed by insert molding. In the makeup in FIG. 6, at the end position of case 21 enclosing central hole 11A on board 11, circular part 21B covers the top surface. Circular part 21B links circularly with resin composed integrally with supporting projections 21A, including the top end of supporting projections 21A. In such a shape, supporting projections 21A are mutually connected to improve filling rate of resin when molding supporting projections 21A, making easy to form itself with desired dimensions, as well as reducing occurrences of lift of board 11.

When combining case 21 with rotor 14 shown in FIG. 1, the bottom surface of intermediate step 14E provided on the outer circumference of shaft 14C contacts only the top surface of circular part 21B, which is a resin surface. Consequently, the rotation touch becomes further favorable.

A rotating electronic part according to the present invention is not limited to the rotating variable resistor described above. For example, the rotating electronic part may be a rotary encoder that has a board provided with comb-teeth-like electrodes on its surface, instead of board 11, where a brush slides on the electrodes to generate pulse signals. Although brushes 15 are provided on the bottom surface of flange 14B, brushes 15 may be extended directly from shaft 14C without flange 14B being provided. Alternatively, a metal roller or metal ball may be used instead of brush 15 so as to contact resistor element part 11B, conductive part 11C, or the electrodes on board 11, thus a contact may be provided to contact with board 11 for outputting electric signals outward. Further, the present invention can be widely applied to electronic parts having a component rotatably fitting, in general.

In the above-mentioned description, case 13 or case 21 is formed by insert-molding board 11. However, a method of forming the case is not limited to this one. For example, the following method may be used. That is, compose the case of two parts, upper and lower; provide the lower part with fit hole 13A and supporting projections 13C; insert board 11 with each supporting projection 13C fitting each notch 11D; and then cover the parts with the upper part of the case.

As mentioned above, a rotating electronic part according to the present invention prevents roughness and shaving that occur between shaft 14C and the end surface of central hole 11A on board 11. Consequently, rotating electronic parts with a favorable operation touch and high reliability are obtained. This makeup is useful for composing an input operation unit for various types of electronic devices, for controlling temperature of a car air-conditioner, and for controlling audio and visual signals of a household electronic appliance such as audiovisual equipment.

What is claimed is:

1. A rotating electronic part comprising:

a board provided with a central hole, and at least three notches at even angular intervals around the central hole;

a case made of insulating resin, for fixing the board so as to maintain a penetration state of the central hole on the board;

supporting projections made of resin structured integrally with the case, and projecting to an inner radius of the central hole, a part of each of the supporting projections being provided in one of the notches; and a rotating member having:

a shaft inserted in the central hole on the board and rotatably supported at distal ends of the supporting projections; and a contact for outputting an electric signal outward, the contact facing to the board, making a rotational movement with rotation of the shaft, and contacting with the board.

2. The rotating electronic part as defined in claim 1, wherein a shear plane is exposed in an inner circumference of the central hole.

3. The rotating electronic part as defined in claim 1, wherein a distal end of each of the supporting projections is shaped like a semicylinder to support the shaft of the rotating member in a line contact state in an axis direction of the shaft.

4. The rotating electronic part as defined in claim 1, wherein each of the supporting projections is provided at each of the notch, excluding an end position contacting the central hole.

5. The rotating electronic part as defined in claim 1, wherein a top surface of an end position around the central hole on the board is covered with resin structured integrally with the supporting projections.

6. A method of manufacturing a rotating electronic part comprising:

step A for providing a board with a central hole, and at least three notches around the central hole at even angular intervals;

step B for forming a case made of insulating resin, for fixing the board so as to maintain a penetration state of the central hole on the board;

step C for forming supporting projections made of resin structured integrally with the case, and projecting to an inner radius of the central hole, a part of each of the supporting projections being provided in one of the notches; and step D for inserting a shaft of a rotating member in the central hole on the board, the rotating member having the shaft rotatably supported at distal ends of the supporting projections and a contact for outputting an electric signal outward, the contact facing to the board, making a rotational movement with rotation of the shaft, and contacting with the board.

7. The method of manufacturing the rotating electronic part as defined in claim 6, wherein the board is die-cut in the step A, and a shear plane is exposed in an inner circumference of the central hole.

8. The method of manufacturing the rotating electronic part as defined in claim 6, wherein the case is formed by insert-molding the board in the step B, and simultaneously the supporting projections are formed by filling the notches with the insulating resin by insert molding in the step C.

* * * * *